United States Patent [19]

Sakamoto

[11] Patent Number: 4,485,639

[45] Date of Patent: Dec. 4, 1984

[54] COOLING DEVICE FOR A REFRIGERATOR COMPRESSOR

[75] Inventor: Noriaki Sakamoto, Ibaraki, Japan

[73] Assignee: Tokyo Shibaura Kenki Kabushiki Kaisha, Japan

[21] Appl. No.: 467,881

[22] Filed: Feb. 18, 1983

[30] Foreign Application Priority Data

Jul. 19, 1982 [JP] Japan ..... 57-126033

[51] Int. Cl.[3] ..... F25B 31/00

[52] U.S. Cl. ..... 62/505; 62/119; 62/434; 62/469; 62/513; 165/104.21

[58] Field of Search ..... 62/119, 434, 505, 513, 62/469; 165/104.21, 104.28

[56] References Cited

U.S. PATENT DOCUMENTS 4,377,938 3/1983 Crespin et al. ..... 62/505

FOREIGN PATENT DOCUMENTS 543721 3/1942 United Kingdom .
546767 7/1942 United Kingdom .
2076140 11/1981 United Kingdom .

*Primary Examiner*—Ronald C. Capossela
*Attorney, Agent, or Firm*—Cushman, Darby & Cushman

[57] ABSTRACT

A compressor included in a refrigerative cycle is disposed in a refrigerator with a rear plate and side plates. The cooling device for the compressor includes a thermo-siphon which includes a closed pipe loop disposed independent of the refrigerative cycle to cool the compressor. The thermo-siphon contains a gaseous liquid refrigerant corresponding to 60% to 80% of the inner volume of the closed pipe loop and has a heat absorbing portion immersed in an oil stored in the compressor and a heat discharging portion at least a part of which thermally contacts the rear plate or the side plates.

5 Claims, 7 Drawing Figures

COOLING DEVICE FOR A REFRIGERATOR COMPRESSOR

BACKGROUND OF THE INVENTION

This invention relates to a cooling device for a refrigerator compressor, and in particular to a cooling device for a refrigerator compressor utilizing a thermo-siphon.

A refrigerator compressor constitutes one unit of a refrigerative cycle. That is, it is of a closed type adapted to receive a relatively low-temperature and low-pressure refrigerant from an evaporator of the refrigerative cycle into a resevoir, suck the reserved refrigerant into a cylinder of the compressor to cause it to be compressed, and supply the compressed gaseous refrigerant into a tube of the refrigerative cycle. Such a compressor is not provided with any particular cooling device, because heat generated by the operation of the compressor is absorbed by a relatively low-temperature refrigerant which flows from the evaporator of the refrigerative cycle. However, the refrigerant flowing into the compressor is heated by the heat generated from the compressor during its operation, thus lowering the efficiency of the refrigerative cycle. As a means for preventing such a drawback an oil condenser system is used. This oil condenser system condenses a compressed refrigerant discharged from the compressor by the heat radiant portion of the refrigerative cycle, causes the condensed refrigerant to be passed through a heat absorbing portion immersed in an oil stored in the compressor, thus causing the oil to be cooled, and supplies the refrigerant passed through the heat absorbing portion to a condenser of the refrigerative cycle. This oil condenser system is of such an arrangement as to connect the heat discharging portion and heat absorbing portion between the compressor of the refrigerative cycle and the condenser of the refrigerative cycle, thus lengthening the passage of the refrigerative cycle and increasing the amount of refrigerant to be sealed in a pipe of the refrigerative cycle. Therefore, in order to compress and liquefy the refrigerant of the refrigerative cycle it is necessary to increase the capacity of the compressor. There is also a problem that the power consumption of the compressor will be increased.

SUMMARY OF THE INVENTION

It is accordingly the object of this invention to provide a cooling device for a refrigerator compressor which can improve the efficiency of a refrigerative cycle without increasing the capacity of the compressor and can also reduce its power consumption.

In this invention, there is provided a cooling device for a compressor included in a refrigerative cycle of a refrigerator with a rear plate and side plates, which includes a thermo-siphon having a heat absorbing portion and heat discharging portion and a closed metallic pipe loop which is filled with a predetermined amount of refrigerant and disposed independent of the refrigerative cycle, the heat absorpting portion being immersed in an oil stored in the compressor to cool the compressor, and the heat discharging portion thermally contacting the inner surface of one of the rear plate and the side plates which discharges the heat conducted from the heat discharging portion.

DETAILED DESCRIPTION OF THE PREFERRED EMBODIMENTS

Figure 1:
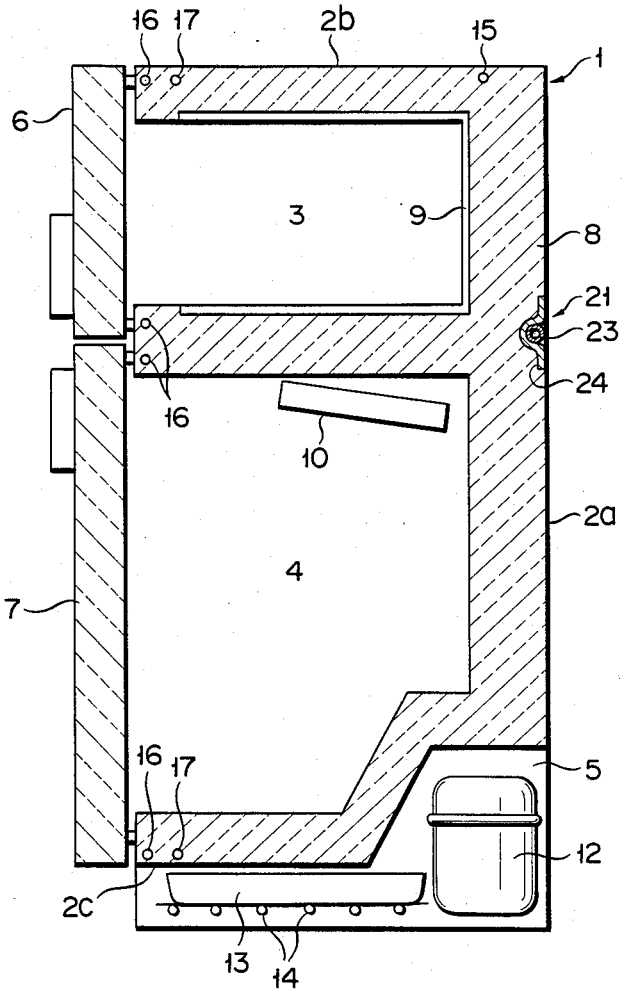
FIG. 1 is a cross-sectional view of a refrigerator containing a cooling device according to one embodiment of this invention.

In FIG. 1 a refrigerator 1 includes a rear plate 2*a*, upper plate 2*b*, a base plate 2*c*, side plates (not shown), freezing compartment 3, cold storage compartment 4, machine compartment 5, openable door 6 of the freezing compartment 3, and openable door 7 of the cold storage compartment. A heat insulating material 8 is provided between the bottom wall of the freezing compartment 3 and the upper wall of the cold storage compartment 4, the upper wall of the freezing compartment 3 and the top wall of the refrigerator 1, the bottom wall of the cold storage compartment 4 and the base plate 2*c* of the refrigerator, the rear plate 2*a* of the refrigerator and rear walls of the freezing compartment and cold storage compartment, and between the side walls of the freezing compartment 3 and cold storage compartment 4 and the side plates, not shown, of the refrigerator. Similarly, a heat insulating material is disposed in the inside of the doors 6 and 7. An evaporator (a first evaporator) 9 for the freezing compartment is arranged along the inner wall of the freezing compartment and an evaporator (a second evaporator) for the cold storage compartment is arranged at the upper space of the cold storage compartment. The machine compartment 5 is open at the front side (door side) and rear side (rear plate side) to secure an air passage through the machine compartment. A compressor 12 is located on the rear plate side of the machine compartment 5 and a drain pan 13 is disposed under the base plate 2*c*. A first serpentine heat discharging tube 14 for heating the drain pan is connected at one end to a refrigerant outlet of the compressor 12 (not shown) and at the other end to the end of a second discharging tube 15. The second discharging tube 15 is arranged in a zigzag fashion along the side plates and upper plate 2*b*. The second heat discharging tube 15 is connected at the other end to the end of a first condensate-retardation tube 16. The tube 16 is arranged at the front portion of the refrigerator such that it is located along the marginal edges of the openings of the freezing compartment 3 and cold storage compartment 4. The first condensate-retardation tube 16 is connected at the other end to one end of a second condensate-retardation tube 17 which in turn is arranged such that it is curved in a substantially rectangular configuration at the rear plate side *2a* of the first condensate-retardation tube 16. The first and second heat discharging tubes 14 and 15 and first and second condensate-retardation tubes 16 and 17 constitute a condenser 18 of a refrigerative cycle 20 of the refrigerator 1. The outlet of the condenser 18 i.e. the other end of the second condensate-retardation tube 17 is connected through a capillary tube (not shown) to the end of the second evaporator 10. The second evaporator 10 is connected at the other end to one end of the first evaporator 9. The other end of the first evaporator 9 is connected through a suction pipe (not shown) to a refrigerant inlet (not shown) of the compressor 12. The above-mentioned refrigerant passage constitutes a passage of the refrigerative cycle 20.

A thermo-siphon 21 includes one pipe constituting a curved closed loop and has a refrigerant inside the closed loop. The refrigerant in the thermo-siphon 21 is the same as that in the loop of the refrigerative cycle 20 and the amount of refrigerant (as a liquid) in the thermo-siphon is 60% to 80% of the inner volume of the loop of the thermo-siphon. The thermo-siphon 21 has a heat absorbing portion 22 (FIG. 2) and heat discharging portion 23. The heat absorbing portion 22 of the thermo-siphon 21 is immersed in a cooling oil, not shown, which is stored within the compressor 12 to cool the compressor. The heat discharging portion 23 of the thermo-siphon 21 is attached to the inner surface of the rear plate *2a* by a good thermo-conductive tape such as an aluminium foil tape 24. The rear plate *2a* discharges the heat conducted from the heat discharging portion 23.

The refrigerative cycle of the refrigerator 1 and function of the thermo-siphon 21 will be explained below by referring to FIGS. 1 to 3. At the operation time of the refrigerator 1 a high-temperature high-pressure gaseous refrigerant discharged through the outlet of the compressor 12 sequentially flows into the first and second heat discharging tubes 14 and 15, where it discharges heat and is gradually liquefied. Then, the refrigerant is sequentially passed through the first and second condensate-retardation tubes 16 and 17 where it discharges heat and is almost all liquefied. The liquid refrigerant flows through the above-mentioned capillary tube to the second and first evaporators 10 and 9 to cool the cold storage compartment 4 and freezing compartment 3. As a result, the liquid refrigerant is again evaporated and returned through the suction pipe, not shown, to the inlet of the compressor 12. By the repetitive circulation of the refrigerant in the refrigerative cycle 20 the cold storage compartment 4 and freezing compartment 3 are cooled to respective setting temperatures.

During the operation of the refrigerator a motor and cylinder (not shown) of the compressor emit heat, but are cooled by the before-mentioned stored oil. The oil is cooled by the above-mentioned thermo-siphon 21. The function of the thermo-siphon 21 will be explained below referring to the fundamental view of FIG. 3. The heat absorbing portion 22 of the thermo-siphon which is immersed in the oil is heated by the heat of the oil. The refrigerant in the heat absorbing portion 22 is heated i.e. absorbs the heat of the oil and boils, causing bubbles A to occur in the refrigerant. With the ascent of the bubbles the heated liquid refrigerant goes up in a direction as indicated by an arrow B and emits heat at the heat discharging portion 23 of the thermo-siphon. Since the heat discharging portion 23 of the thermo-siphon contacts the rear plate *2a* in a better thermo-conductive state, the heat discharging portion 23 of the thermo-siphon discharges heat through the rear plate *2a* toward the outside of the refrigerator. With the ascent of the bubbles A, the refrigerant is gradually cooled and, after it has passed through the heat discharging portion 23, most of the refrigerant is condensed into a liquid. The liquid refrigerant increases in density by this condensation and falls under its own weight back to the heat absorbing portion 22 in the direction indicated by an arrow C. Since the oil is cooled by the repetitive cycle of heat absorption and heat radiation of the thermo-siphon, the compressor 12 is cooled. The cooling of the oil by the thermo-siphon utilizes the natural circulation of the refrigerant and, even if the operation of the compressor 12 is stopped, the thermo-siphon continues to cool the oil so long as the oil is at a high temperature.

Tests were made for the cooling capacity for the cooling system of the compressor 12 under the before-mentioned oil condenser cooling system and under the thermo-siphon cooling system, the results of which are shown in Table 1. The tests were conducted under the condition that the heat discharging portion of the oil condenser cooling system and that of the thermo-siphon cooling system were located in substantially the same position and that the refrigerator was continuously operated at a room temperature of 35° C.

TABLE 1

| | COOLING SYSTEMS | |
|---|---|---|
| MEASURED ITEMS | THERMO-SIPHONE 21 | OIL CONDENSER |
| TOP TEMPERATURE °C. OF COMPERSOR 12 | 81.0 | 90.2 |
| MOTOR WINDING TEMPERATURE °C. OF COMPRESSOR 12 | 87.2 | 95.7 |

As is evident from Table 1, with the thermo-siphon cooling system the top temperature of the compressor 12 can be lowered by about 9.2° C. compared with the oil condenser cooling system, and the temperature of the winding of the compressor motor can be lowered by about 8.5° C. compared with the oil condenser cooling system. The reason why the thermo-siphon cooling system is effective in comparison with the oil condenser cooling system is as follows:

(1) The thermo-siphon requires no power, because it performs a cooling function through the natural circulation of the refrigerant. The oil condenser cooling system, on the other hand, must increase the power for circulating the refrigerant, i.e., the power for driving the compressor.

(2) The thermo-siphon has excellent properties in heat absorption compared with the oil condenser cooling system, because it performs a cooling function through the utilization of the latent heat of the refrigerant.

(3) Since the oil condensor is connected in series with the loop of the refrigerative cycle of the refrigerator, it is necessary to fill an excess amount of refrigerant corresponding to the inner volume of the oil condenser into the oil condenser loop. This means that the output of the compressor is increased by that extent and thus the heat amount radiated from compressor is increased.

(4) The oil condensor cools the oil only during the operation of the compressor. The thermo-siphon, on the other hand, continues to perform the cooling operation even after the compressor stops, so long as the oil is at a high temperature.

Figure 4:
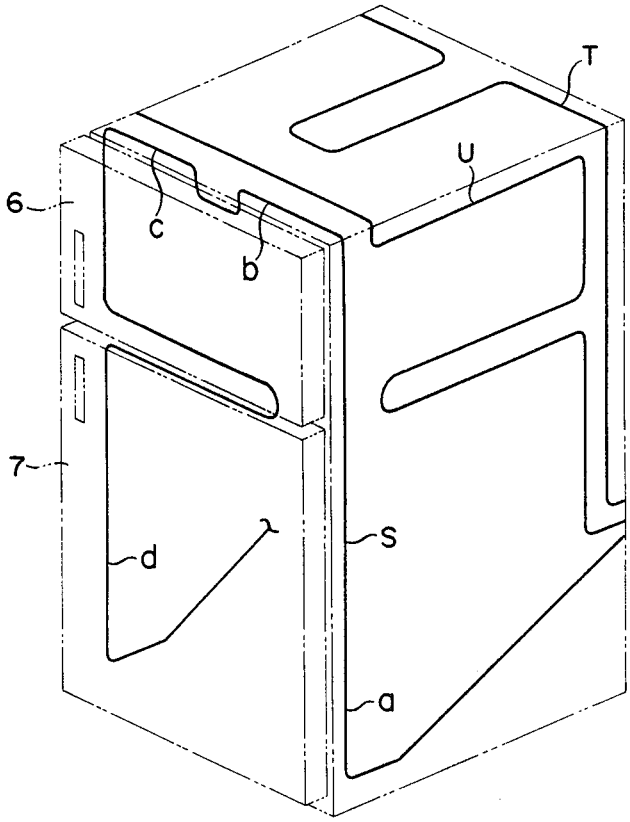
FIG. 4 is a perspective view showing a part of the refrigerative cycle and part of the thermo-siphon when the cooling device for the compressor is mounted at the front section of the refrigerator.

The reason why the heat radiant portion of the thermo-siphon is thermally contact with the rear plate 2a or the side plate of the refrigerator is as follows:

In an embodiment of FIG. 4 a heat discharging portion of a thermo-siphon S is arranged along the marginal edges of the openings of the cold storage compartment 4 and freezing compartment (FIG. 1) so that it can be utilized as a condensate-retardation tube. In FIG. 4, first and second heat discharging tubes T and U of the refrigerative cycle are arranged along the inner surfaces of the side plate and upper plate of the refrigerator. A third heat discharging tube (not shown) of the refrigerative cycle is meanderingly arranged at the front portion of the machine compartment (5 in FIG. 1) and a fourth heat discharging tube (not shown) of the refrigerative cycle is meanderingly arranged at the inner surface of the rear plate of the refrigerator. The first to the fourth heat discharging tubes constitute a condenser of the refrigerative cycle. The inventor of this invention continuously operated the refrigerator of FIGS. 2 and 4 at a room temperature of 35° C. and obtained data for the temperature of each part of the refrigerator, thermo-siphon and compressor, and for the power consumption of the compressor.

TABLE 2

| MEASURED ITEMS | | THERMO-SIPHON SETTING POSITIONS: REAR PLATE 2a OF FIG. 2 (21) | THERMO-SIPHON SETTING POSITIONS: FRONT PORTION OF REFRIGERATOR OF FIG. 4 (S) |
|---|---|---|---|
| TEMPERATURE °C. WITHIN FREEZING COMPARTMENT 3 | | −26.5 | −25.1 |
| TEMPERATURE °C. ON LOWER WALL OF FREEZING COMPARTMENT 3 | | −30.6 | −27.9 |
| TEMPERATURE °C. ON SURFACE OF 2ND EVAPORATOR 10 | | −30.0 | −27.3 |
| TEMPERATURE °C. WITHIN COLD STRAGE COMPARTMENT 4 | | −16.3 | −14.9 |
| CONDENSATION TEMPERATURE °C. OF REFRIGERANT IN REFRIGERATIVE CYCLE | | 43.0 | 51.3 |
| TOP TEMPERATURE °C. OF COMPRESSOR 12 | | 75.9 | 74.4 |
| TEMPERATURE °C. OF THERMO-SIPHON 21 OR S | POINT a | 55.7 | 50.7 |
| | POINT b | 57.5 | 52.0 |
| | POINT c | 57.6 | 50.9 |
| | POINT d | 60.0 | 48.4 |
| INPUT POWER W TO COMPRESSOR 12 | | 99.8 | 106.0 |
| TEMPERATURE °C. OF COMPRESSOR MOTOR WINDING | | 85.9 | 85.1 |

As evident from Table 2, with the refrigerator equipped with the thermo-siphon 21 (FIG. 2) as compared with the refrigerator equipped with the thermo-siphon S (FIG. 4), the condensation temperature of the refrigerant in the refrigerative cycle is decreased by 8.3° C. and the input power of the compressor 12 is decreased by 6.2 W.

Figure 2:
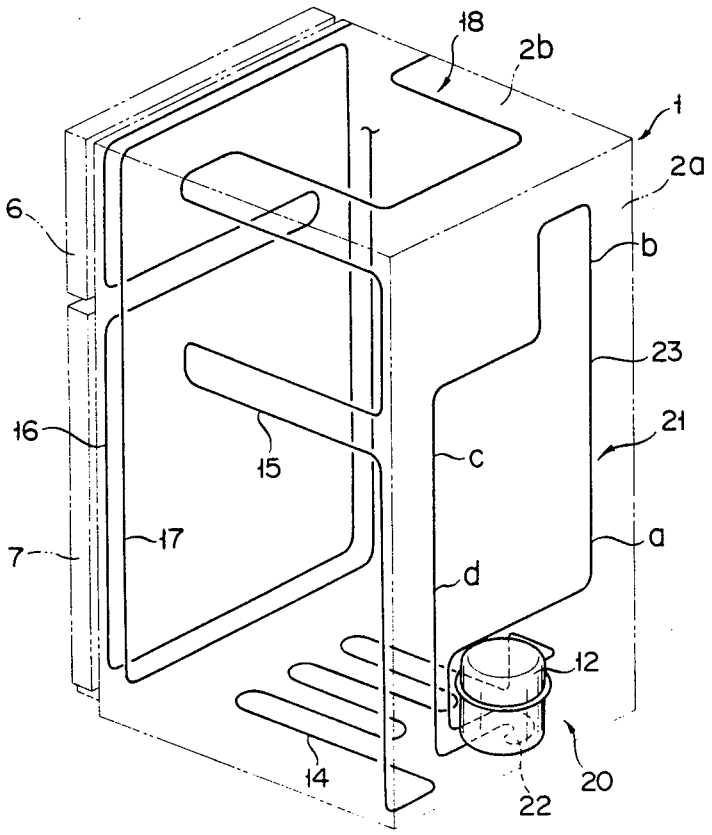
FIG. 2 is a perspective view showing the cooling device for a compressor in connection with a refrigerative cycle.
Figure 3:
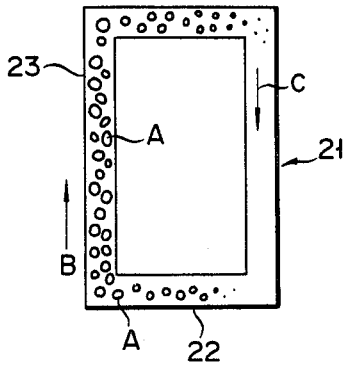
FIG. 3 is a fundamental view of a thermo-siphon for explaining the operation of the cooling device.

The inventor also operated the refrigerators of FIGS. 2 and 4 for one day under identical conditions and calculated the amount of power consumption for one month on the basis of the resultant data. That is, the operating rate of the first evaporator, for the freezing compartment and of the second evaporator for the cold storage compartment, as well as the power consumption of the refrigerator, was measured. The results of the calculation are shown in Table 3. In Table 3, the refrigerator was operated with the doors 6 and 7 of the freezing compartment 3 and cold storage compartment 4 intermittently opened and closed for the day (i.e. over 10 hours) and with these doors left closed for the night (i.e. over 14 hours).

TABLE 3

| MEASURED ITEMS | | THERMO-SIPHON SETTING POSITIONS: REAR PLATE 2a OF FIG. 2 (21) | THERMO-SIPHON SETTING POSITIONS: FRONT PORTION OF REFRIGERATOR OF FIG. 4 (S) |
|---|---|---|---|
| 10 HR OPERATION IN THE DAY TIME | OPERATION RATE (%) OF IST EVAPORATOR 9 | 38.1 | 43.3 |
| | OPERATION RATE OF 2ND EVAPORATOR 10 | 19.8 | 24.2 |
| 14 HR OPERATION AT NIGHT TIME | OPERATION RATE (%) OF 1ST EVAPORATOR 9 | 26.1 | 26.0 |
| | OPERATION RATE (%) OF 2ND EVAPORATOR 10 | 10.3 | 12.9 |
| POWER CONSUMPTION (kWh/MONTH) OF REFRIGERATOR 1 | | 26.6 | 30.4 |

From Table 3 it will be evident that with the thermo-siphon 21 (FIG. 2), as compared with the thermo-siphon S (FIG. 4), the operation rates of the first and second evaporators 9 and 10 are improved and that the amount of power consumption of the refrigerator 1 is decreased by 3.8 kWh per month. The thermo-siphon S (FIG. 4) can be used for condensate-retardation, but it warms the inside of the freezing compartment 3 and cold storage compartment 4, resulting in an increase in the operation rate of the first and second evaporators 9 and 10. If as shown in FIG. 1 the thermo-siphon 21 is arranged on the inner surface of the rear plate 2a and a part of the condenser 18 of the refrigerative cycle is used for condensate-retardation, the condensation temperature of the refrigerant in the refrigerative cycle 20 is lowered. Consequently, an amount of heat radiated from the condensor 18 becomes suitable for condensate-retardation and does not warm the inside of the freezing compartment 3 and cold storage compartment 4. This is the reason why the operation rates of the first and second evaporators 9 and 10 can be decreased in the refrigerator of FIG. 1.

In the refrigerator having the thermo-siphon 21 at the rear plate 2a as shown in FIG. 2, the inventor measured a JIS (Japanese Industrial Standard) refrigeration speed and operation rate (%) of the first and second evaporators 9 and 10 when the thermo-siphon 21 was in both an operative state and a non-operative state. The results of the measurement are shown in Table 4.

TABLE 4

| MEASURED ITEMS | | THERMO-SIPHON 21 OPERATIVE STATE | THERMO-SIPHON 21 NON-OPERATIVE STATE |
|---|---|---|---|
| JIS REFRIGERATION SPEED | FREEZING COMPARTMENT 3 | ONE HOUR AND 55 MINUTES | 2 HOUR AND 1 MINUTE |
| | COLD STORAGE COMPARTMENT 4 | 53 MINUTES | 58 MINUTES |
| OPERATION RATE OF EVAPORATORS | 1ST EVAPORATOR 9 | 41.1% | 44.7% |
| | 2ND EVAPORATOR 10 | 20.5% | 23.1% |

The JIS refrigeration speed corresponds to the times for the freezing compartment 3 and cold storage compartment 4 to be cooled from 30° to −5° C. and 30° C. to 10° C., respectively, when the refrigerator is operated at a room temperature of 30° C. As evident from Table 4 with the refrigerator equipped with the thermo-siphon 21 the JIS refrigeration speed can be increased by six minutes for the freezing compartment 3 and by 5 minutes for the cold storage compartment 4, the operation rates (%) of the evaporators 9 and 10 can be decreased, and thus, it is possible to enhance the refrigeration capacity of the refrigerator.

The liquid refrigerant in the thermo-siphon 21 is the same as the refrigerant used in the refrigerative cycle, permitting the ready manufacture of the thermo-siphon 21. If an excessive amount of refrigerant is put into the loop of the thermo-siphon 21, there is a possibility that the thermo-siphon 21 will rupture due to expansion of the refirgerant resulting from the temperature rise. If, on the other hand, the amount of refrigerant is too small, the circulation of the refrigerant becomes unstable, making it impossible to provide adequate heat transmission. In order to find an optimal amount of refrigerant the inventor conducted tests and obtained data as shown in Table 5.

TABLE 5

| MEASURED ITEMS | % AMOUNT OF FILLED REFRIGERANT 0 | 27 | 41 | 58 | 62 | 76 | ≈ 100 |
|---|---|---|---|---|---|---|---|
| TEMPERATURE °C. WITHIN FREEZING COMPARTMENT 3 | −22.8 | −22.8 | −22.5 | −22.5 | −22.5 | −22.5 | −22.5 |
| TEMPERATURE °C. ON LOWER WALL OF FREEZING COMPARTMENT 3 | −26.5 | −26.5 | −26.1 | −26.1 | −26.1 | −26.1 | −26.1 |
| SURFACE TEMPERATURE °C. OF 2ND EVAPORATOR 10 | −25.2 | −25.1 | −24.9 | −24.9 | −24.9 | −24.9 | −24.9 |
| TEMPERATURE °C. WITHIN COLD STORAGE COMPARTMENT 4 | −12.2 | −12.2 | −12.0 | −12.0 | −12.0 | −12.0 | −12.0 |
| CONDENSATION TEMPERATURE °C. OF REFRIGERANT IN REFRIGERATIVE SYCLE | 49.8 | 49.8 | 49.9 | 49.9 | 49.9 | 49.9 | 49.9 |
| TOP TEMPERATURE °C. OF COMPRESSOR 12 | 98.2 | 95.7 | 81.1 | 81.0 | 81.2 | 82.0 | 87.0 |
| TEMPERATURE °C. OF THERMO-SIPHON 21 — POINT a | 51.0 | 45.8 | 64.2 | 62.3 | 60.8 | 66.4 | 69.5 |
| POINT b | 35.3 | 44.5 | 64.0 | 63.6 | 61.8 | 65.4 | 82.2 |
| POINT c | 33.7 | 44.6 | 63.2 | 63.5 | 64.0 | 65.0 | 58.2 |
| POINT d | 45.6 | 47.8 | 62.9 | 63.2 | 64.8 | 64.7 | 57.9 |
| INPUT POWER W TO COMPRESSOR 12 | 110.0 | 110.5 | 110.0 | 110.0 | 110.0 | 110.0 | 110.0 |
| TEMPERATURE °C. OF COMPRESSOR MOTOR WINDING | 105.8 | 103.8 | 88.6 | 87.2 | 87.5 | 88.2 | 92.7 |

From Table 5 it can be seen that, when an amount of refrigerant is about 40 to 80%, better results can be obtained. When the amount of refrigerant is about 40 to 60%, the thermo-siphon shows unstable cooling characteristics, leading to a temporary rise in temperature. From these it can be concluded that the optimal amount of refrigerant is 60 to 80%.

The inventor conducted tests for the cooling effects of the thermo-siphon both when air is evacuated from the loop of the thermo-siphon and when no such evacuation is effected. The results of the tests are shown in Table 6.

TABLE 6

| MEASURED ITEMS | | VACUUM TREATMENT TREATED | VACUUM TREATMENT NOT-TREATED |
|---|---|---|---|
| TEMPERATURE °C. WITHIN FREEZING COMPARTMENT 3 | | −22.5 | −22.5 |
| TEMPERATURE °C. ON LOWER WALL OF FREEZING COMPARTMENT 3 | | −26.1 | −26.1 |
| SURFACE TEMPERATURE °C. OF 2ND EVAPORATOR 10 | | −24.9 | −24.9 |
| TEMPERATURE °C. WITHIN COLD STORAGE COMPARTMENT 4 | | −12.0 | −12.0 |
| CONDENSATION TEMPERATURE °C. OF REFRIGERANT IN REFRIGERATIVE CYCLE | | 49.9 | 49.9 |
| TOP TEMPERATURE °C. OF COMPRESSOR 12 | | 81.2 | 81.6 |
| TEMPERATURE °C. OF THERMO-SIPHON 21 | POINT a | 60.3 | 62.0 |
| | POINT b | 61.8 | 63.7 |
| | POINT c | 64.0 | 64.7 |
| | POINT d | 64.8 | 65.5 |
| INPUT POWER W TO COMPRESSOR 12 | | 110.0 | 110.0 |
| TEMPERATURE °C. OF COMPRESSOR MOTOR WINDING | | 87.5 | 87.6 |

From Table 6 it has been found that the air remaining in the thermo-siphon loop does not substantially affect the cooling effect of the thermo-siphon.

The reason for this is as follows:

(1) When the thermo-siphon is operated at about 60° C., the refrigerant pressure within the pipe of the thermo-siphon 21 becomes greater than 15 kg/cm$^2$abs., thus compressing the air in the pipe to 1/15 of its initial volume or less.

(2) The air mixed with the refrigerant is naturally circulated by the flow of the refrigerant through the thermo-siphon 21, thus causing no stagnation of air and also no prevention of heat radiation. It is therefore possible to use a pipe loop without evacuating the air.

The effects of the embodiment as shown in FIG. 2 are summarized as follows.

The thermo-siphon 21 of FIG. 2 permits reducing the power consumption of the refrigerator as compared with the thermo-siphon of FIG. 4. The refrigerator with the thermo-siphon can lower the temperature of the compressor 10 as compared with the refrigerator without the thermo-siphon. The above-mentioned features permit an extension of the compressor's life. Further, it is possible to increase the cooling speeds of the first and second evaporators and reduce the operation rate of the evaporator. Since the known heat pipe is complicated in construction and costly, it is not suited for use in place of a thermo-siphon. The thermo-siphon, on the other hand, is simpler in arrangement and a refrigerant filling device for the refrigerative cycle can also be used for the thermo-siphon. As a result, the manufacturing cost of the refrigerator is not essentially increased.

Figure 5:
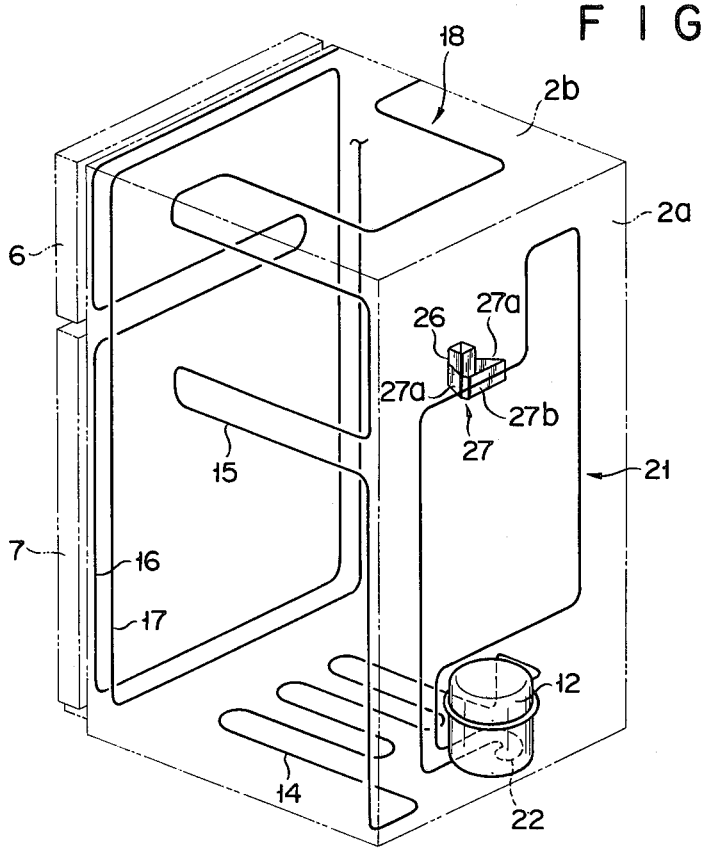
FIG. 5 is a perspective view showing a thermo-siphon and refrigerative cycle of a refrigerator embodying a cooling device according to another embodiment of this invention.
Figure 6:
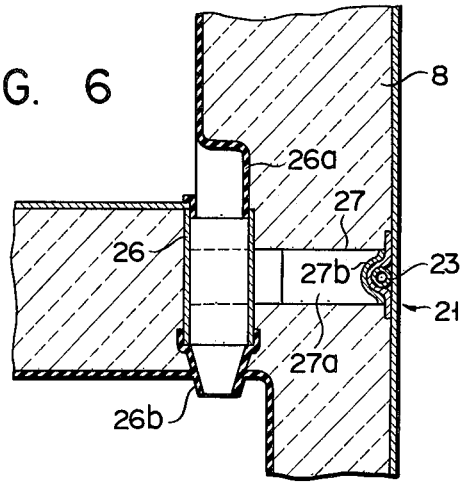
FIG. 6 is an enlarged, cross-sectional view showing a part of the cooling device of FIG. 5.

Another embodiment of this invention will be explained by referring to FIGS. 5 and 6. Similar reference numerals are employed in FIGS. 5 and 6 to designate like parts or elements corresponding to those shown in FIGS. 1 to 3 and so explanation will be limited only to different parts and elements. A drain pipe 26 rectangular in cross section is connected at one end to a discharge outlet made of plastic and provided on the rear wall of the freezing compartment 3 and at the other end to a receiving inlet **26*b* made of plastic and extending through the upper wall of the cold storage compartment 4. In this way, the freezing compartment 3 communicates with the cold storage compartment through the drain pipe 26. A thermo-conductive member 27 such as an aluminum band-like plate is bent into a form as shown in FIG. 5 and has portions 27*a*, 27*a* thermally contacted directly with side surfaces of the drain pipe 26 and a portion 27*b* which is thermally connected to the portions 27*a* and 27*a*. The heat discharging portion 23 of the thermo-siphon thermally contacts the portion 27*b* of the member 27. This arrangement prevents water defrosted in the freezing compartment 3** from being refrozen, thus permitting the discharging of the defrosted water.

Figure 7:
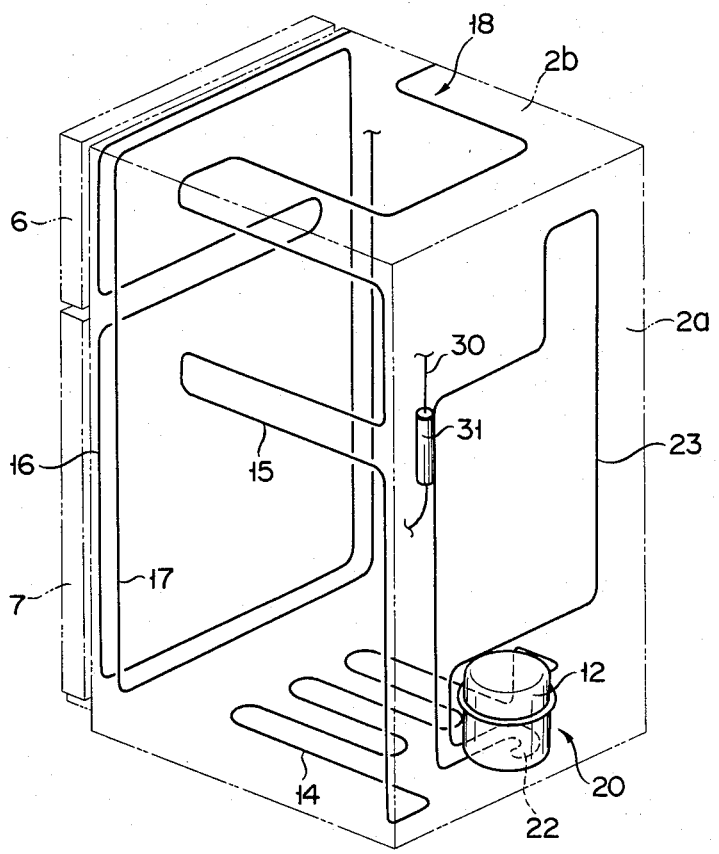
FIG. 7 is a perspective view showing a thermo-siphon and refrigerative cycle of a refrigerator embodying a cooling device according to another embodiment of this invention.

Another embodiment of this invention will be explained below by referring to FIG. 7. In this embodiment, like reference numerals are employed to designate like parts or elements corresponding to those shown in FIGS. 1 to 3 and explanation is restricted only to different parts or elements. Reference 30 is a communication tube for permitting communication between the first and second evaporators 9 and 10. A spacer 31 is disposed on the outer periphery of the communication tube 30 and formed by attaching a thermo-conductive material, such as an aluminum foil, to the whole outer periphery of an elastic material. The aluminum foil contacts a part of the heat discharging portion 23 of the thermo-siphon 21. Freezing may frequently occur on the outer periphery of the communication pipe 30, causing the malfunction of the pipe 30. According to the arrangement as mentioned above, heat is supplied from the heat radiant portion 23 of the thermo-siphon to the communication tube 30 to prevent freezing on the communication tube 30. Further, it is possible to prevent generation of noises due to the mechanical vibrations of the communication tube 30 and thermo-siphon and thus the vibratory contact between the communication tube 30 and the heat discharging portion 23 of the thermo-siphon. The conventional practice is to prevent freezing on the outer surface of the communication tube 30 by an electric heater wound around the outer periphery of the communication tube 30, with the result that the power consumption is increased. According to this embodiment it is possible to prevent an increase in power consumption.

Even if in the above-mentioned embodiments the heat discharging portion 23 of the thermo-siphon thermally contacts one of the side plates **2*b* instead of being contacted with the inner surface of the rear plate 2*a***, the same result can be obtained.

The effects of this invention have been explained in more detail in connection with the data of Tables and the following is a summary of the effects of this invention.

(1) The pressure at the discharge outlet of the compressor is lowered, thereby lowering the condensation temperature of the refrigerant in the refrigerative cycle.

(2) The amount of refrigerant can be reduced as compared with the condenser cooling system.

(3) By causing the heat discharging portion 23 of the thermo-siphon to contact the rear plate or the side plate of the refrigerator, it is possible to prevent its thermal influence on the refrigerator.

(4) The refrigerant of the thermo-siphon is the same as that in the refrigerative cycle.

What is claimed is:

1. A refrigerator comprising:

a rear plate and side plates;

a compressor containing cooling oil and connected in series with a first closed loop for circulating a first refrigerant for performing a refrigeration cycle; and a cooling device for cooling said compressor, said cooling device defining a second closed loop of a thermo-siphon for circulating a second refrigerant, said thermo-siphon being provided independently of said first closed loop and including a heat absorbing portion immersed in the cooling oil to cool said compressor, a heat discharging portion thermally contacting the inner surface of one of said rear or side plates; and wherein said second closed loop is filled with the second refrigerant to 60 to 80% of the second closed loop inner volume.

2. A refrigerator according to claim 1 further comprising a freezing compartment having a first evaporator and a cold storage compartment having a second evaporator, a metallic tube defining a refrigerant passage between said first and second evaporators, and means connected to said metallic tube for preventing freezing of said refrigerant in said refrigerant passage, said freezing-preventing means including a thermo-conductive spacer in thermal contact with said heat discharging portion of said thermo-siphon and an outer periphery of said metallic tube.

3. A refrigerator according to claim 2 wherein said thermo-siphon is a metallic tube and wherein said spacer includes a hollow elastic member and a heat conductive metallic foil attached to the surface of the hollow elastic member, a portion of the heat from said heat discharging portion of said thermo-siphon being transmitted through said heat conductive metallic foil and said hollow elastic member to said metallic tube to prevent freezing on the outer periphery of the said metallic tube, whereby noise resulting from vibratory contact between said metallic tube of said refrigerant passage and said metallic tube of said thermo-siphon is prevented.

4. A refrigerator according to claim 1 in which said second refrigerant is the same as said first refrigerant.

5. A refrigerator according to claim 1 further comprising freezing and cold storage compartments, a metallic drain tube disposed between said freezing compartment and said cold storage compartment of the refrigerator, and means connected to said drain pipe for preventing frost from forming on said drain tube, said frost-preventing means including a thermo-conductive member thermally coupled to an area of said heat discharging portion.

* * * * *